United States Patent [19]

Meneghin et al.

[11] 4,383,621

[45] May 17, 1983

[54] PULL TAB FOR AN EASY OPENING CAN

[75] Inventors: René Meneghin; Ernest Hurther, both of La Fleche, France

[73] Assignee: Cebal, Clichy, France

[21] Appl. No.: 279,159

[22] Filed: Jun. 30, 1981

[30] Foreign Application Priority Data

Jul. 9, 1980 [FR] France ..... 80 15578

[51] Int. Cl.[3] ..... B65D 45/00

[52] U.S. Cl. ..... 220/273

[58] Field of Search ..... 220/269–273

[56] References Cited

U.S. PATENT DOCUMENTS 3,485,411 12/1969 Brown ..... 220/273

4,030,631 6/1977 Brown ..... 220/269

4,183,445 1/1980 LaCrosse ..... 220/273

*Primary Examiner*—George T. Hall

*Attorney, Agent, or Firm*—Dennison, Meserole, Pollack & Scheiner

[57] ABSTRACT

A pull tab for an easy opening can for tearing a pull panel to separate the panel from the can end. The tab is attached to the pull panel by an integral strap which is spirally wound to encircle the anterior portion. The spiral feature provides high shearing stress at the initiation of panel opening and then a flexible connection with the removable panel during continued opening to panel removal.

5 Claims, 3 Drawing Figures

PULL TAB FOR AN EASY OPENING CAN

For a long time, can manufacturers have been attempting to make it easier for consumers to open cans without compromising the strength of these cans during storage and handling.

Thus, German Pat. No. 629,289 or U.S. Pat. Nos. 2,085,200 and 3,232,472 show that it is possible to simplify the tearing of the lid and the pulling of a panel by providing a score line of a carefully determined depth within the thickness of the lid.

The initial perforation of the lid, and the subsequent tearing thereof along the score line, can be further simplified by using a gripping tab fixed to the panel. The part of the tab used as a perforation tool is designated hereinafter as the anterior portion. This anterior portion generally comprises, at its front end, a perforating tip usually with a sharp edge, as shown in German Pat. No. 629,289 or U.S. Pat. No. 3,232,474.

At the opposite or posterior end, the tab generally comprises a gripping means, such as a ring, unless the tab itself is ring-shaped as is usually the case.

The tab is fixed to the panel by a connecting means, usually a rivet situated between the two ends of the tab, permitting the tab to be used as a lever and permitting the effort exerted by the consumer to be multiplied at the moment of initial perforation.

To prevent the connecting means from breaking and to prevent the tab from becoming detached from the panel before the can is completely opened, it is important that the tab be attached to the panel in a sufficiently flexible manner. To this end, the body of the tab is preferably attached to the connecting means by a flexible strap which operates in the manner of a hinge and permits a certain displacement of the tab relative to the surface of the panel.

As shown in U.S. Pat. No. 2,085,200 or French Pat. No. 2,074,598, it may be desirable for the tip of the tab to exceed the score line in the rest position, thus reducing the risks of accidental perforation prior to use. On the other hand, it is desirable for the tip to be able to travel backwards slightly so as to be perpendicular to the score line at the moment when the consumer has to exert the maximum effort on the lid to start the perforation process.

Thus, the present invention relates to a gripping tab for an easy opening can which generally comprises a perforating tip. The body of the tab is attached to the connecting means between the tab and pull panel by a strap which is integral with the anterior portion of the tab body and is directed toward the rear. A particular feature of this strap is that it is wound in a spiral surrounding the transverse anterior portion of the tab body and then extends toward the rear up to the position of the connecting means. This winding imparts fexibility to the tab which rigidifies from the beginning of the opening process by the tightening of the said winding.

The tab is generally provided from a flat blank cut from a thin metal sheet. This blank is then ribbed to impart the desired rigidity to the tab. The tab is generally ring-shaped to simplify the gripping thereof. It can also have a general shape of a rectilinear lever. In this case, the coupling strap should be opened out in the form of two symmetrical lateral straps starting from the anterior portion of the tab. The tab will finally be T-shaped.

The tab body and the connecting strap are produced from the same blank cut from a metal sheet. The desired final shape in imparted to it by successive stamping and folding passes. The strap is thus shaped in a strip of metal in the extension of the one constituting the tab body.

In all cases, the strap should be wound in a spiral around the anterior portion of the tab body in the direction which causes its winding to tighten and consequently causes this winding to rigidify during the lid perforating operation. In order to perforate the lid and then to pull the panel, the tab is pulled by raising it at the rear and by thus causing it to pivot in an axial plane about its anterior portion. Also, to enable the winding of the strap to tighten during opening of the can, the strap should initially be wound around the anterior portion of the tab body in the opposite direction to the rotational direction of the tab relative to its anterior portion when starting to open the can. Furthermore, the rib formed in the blank to impart to the tab its shape and rigidity should be produced with a curvature in continuation of that of the winding of the strap. The concavity of the rib rigidifying the anterior portion of the tab is thus on the same side of the surface of the sheet forming the tab as the concavity of the strap wound into a spiral.

In the case of an annular tab formed from a flat blank which is also annular, the strap originates from a strip of metal which radially extends the flat annular blank. This strip is normally a radial strip reserved inside the cavity of the blank and directed toward the center thereof.

The strap is wound around the portion of the blank to which it is coupled, while this portion of the blank itself is curved to form a rigidifying rib at the anterior portion of the tab body. It is wound by passing firstly beneath the anterior portion of the tab body and then coming upwards, passing above the anterior portion.

If a T-shaped tab is used, each of the two lateral half-straps is also wound around the cross bar of the T in the opposite direction to the rotational direction of the tab about this transverse strip during perforation of the can which starts the pulling of the panel. The central bar of the T is used in the manner of a lever.

The invention will be understood better by means of the following description of a particular example and by examination of the corresponding figures.

Figure 1:
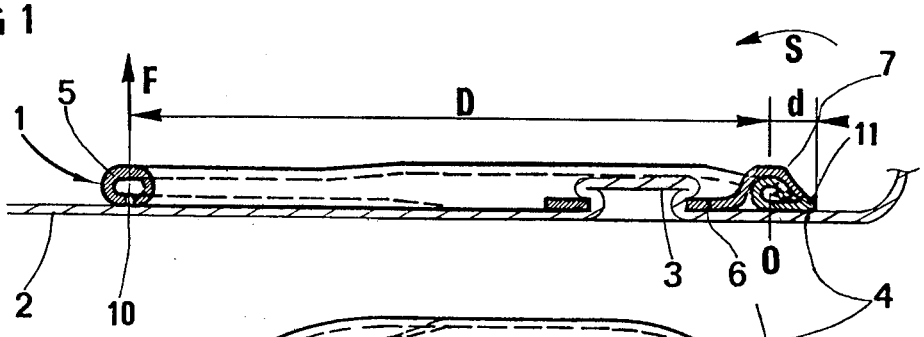
FIG. 1 shows a section through an axial plane of a ring-shaped tab on which the strap is formed by winding a strap to a position inside an annular blank.
Figure 2:
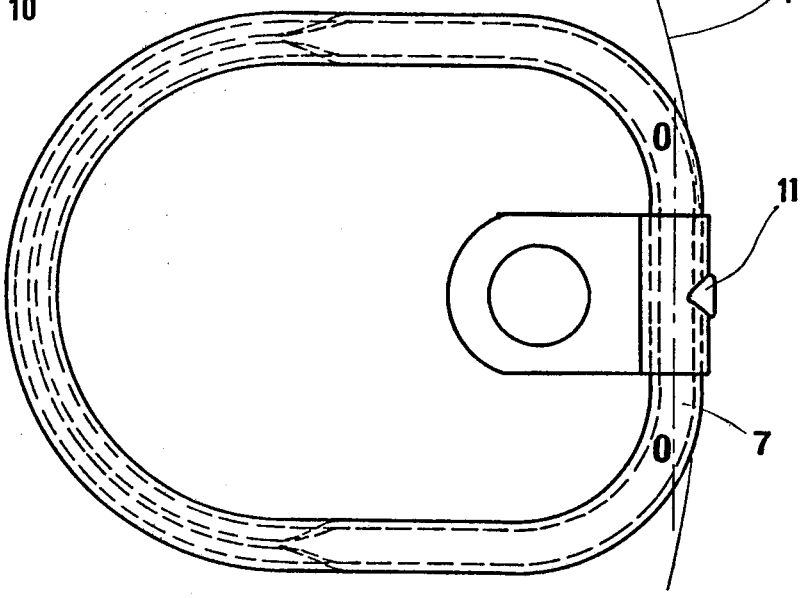
FIG. 2 shows a plan view of the same tab.
Figure 3:
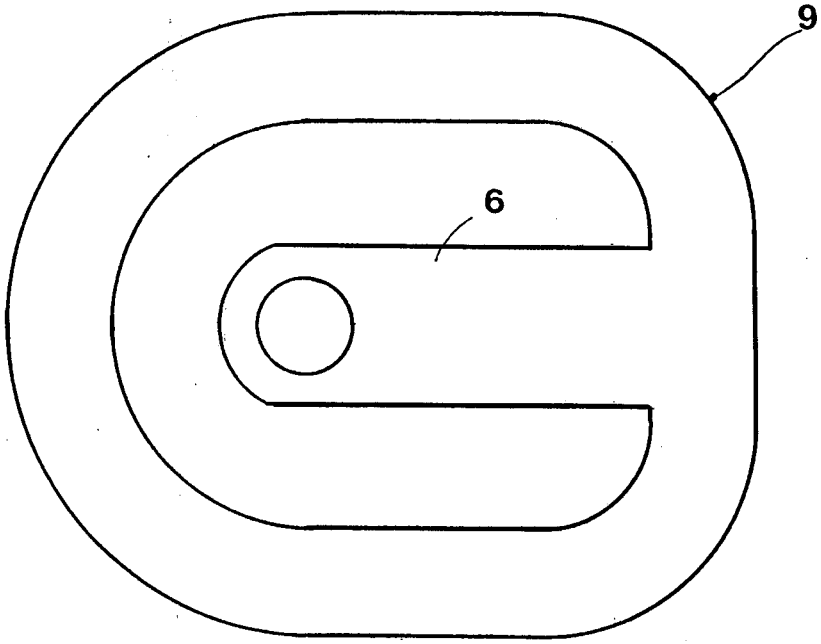
FIG. 3 shows a plan view of the flat blank from which the tab has been formed.

FIGS. 1 and 2 show a tab 1 in the form of a ring resting on a lid 2. The connecting means between the lid and tab is a rivet 3 in this case. A score line 4 defines in the lid a panel which can easily be removed. The tab 1 is essentially constituted by a body in the form of a toric ring 5 made of rolled sheet metal and of a strap 6. The strap 6 is wound in a spiral, essentially making a turn about the transverse anterior portion 7 of the ring 5 and is then extended towards the position of the rivet 3. The ring 5 and the strap 6 are formed from the same flat hollowed blank 9 shown in FIG. 3. This blank 9 is made of aluminum. It is 0.4 mm thick.

The periphery of the blank 9 is curved in the form of a torus, as shown in FIG. 1, by successive passes to impart the desired rigidity to the tab body. At the same time, the strap 6 is wound around the anterior portion 7 of the ring. The coupling slot 10 of this torus is located beneath the tab.

Finally, a perforating tip 11 is formed by stamping the portion of the strap 6 located at the front of the tab.

FIGS. 1 and 2 show that when the ring 1 is raised at the rear with a force F, the ring 1 is firstly caused to rotate about the axis 0 at its anterior portion 7, while the winding of the strap 6 about this anterior portion 7 tends further to tighten up. The tip 11 pivots downward and retracts slightly. It positions itself above the score line 4 on which it exerts a high shearing stress.

At this moment, the tab acts as a lever, of which the axis would be 0. The pressure exerted by the tip 11 on the surface of the lid is approximately equal to the tensile stress F exerted by the consumer multiplied by the coefficient D/d. D is the length of the ring along its axis and d is the horizontal distance between the tip 11 and the axis 0 of the anterior portion of the ring. In this case, D is of the order of 25 mm and d of the order of 2 mm.

After the pivoting of the ring 5 and perforation of the panel by the tip 11, a pulling effort is exerted via this ring 5, the strap 6 and the rivet 3 on the entirety of the panel which tears along the score line 4.

To enable the tab to function correctly, it is important that, at the beginning of the opening process, the spiral winding of the strap 6 tightens up and rigidifies the anterior portion 7 of the tab. It is therefore important in the case under consideration that the strap 6 be wound around the anterior portion 7 in the direction S, that is to say, in the opposite direction to that of the stress F relative to the axis 0, i.e., the negative direction relative to the axis 0 in this case. The strap 6 therefore passes firstly beneath the anterior portion 7 before returning by passing above it toward the rivet 3 situated in the center of the ring.

For the strap 6 to be in the extension of the ribbed surface forming the body of the ring 5, it is important that the bend of the periphery of the blank 9 be provided with a dorsal at its upper portion and with its open slot 10 at the lower portion. Thus, the rib which is torus-shaped in this case and which imparts rigidity to the tab has a curvature in continuation of the curvature of the bracket, at least in its anterior portion.

The concavities of the ribbed anterior portion 7 of the ring and of the strap 6 are both located on the same side of the surface of the thin sheet from which the tab and its strap have been pulled.

Owing to the tightening of the strap 6 about the anterior portion 7 of the ring at the beginning of the perforating process, the tab which was originally relatively flexible gradually stiffens. A perforation is produced in the lid in an easy manner.

We claim:

1. A gripping tab secured to and rotatable in a first direction for initiating removal of a removable panel in an easy open can comprising a substantially ring-shaped finger element including an anterior portion and an integral connecting strap portion, said strap portion including a fixed end secured to said ring and spirally wound thereabout, said strap terminating in a free end extending into the interior of said ring portion and connected therewithin to said removable panel, said spirally wound strap portion encircling said anterior portion in a direction whereby when said rotatable gripping tab is rotated to open said can, the rotation of said tab is in a direction to tighten the spirally wrapped portion of said strap around said anterior portion of said ring-shaped tab.

2. A tab according to claim 1 wherein the entire tab is shaped from a flat annular blank, selected portions of which include a curvature in continuation of the wound direction of said strap.

3. A tab according to claim 1 or 2 wherein a perforating tip is formed on said strap portion of the tab.

4. A tab according to claim 1, 2 or 3 wherein the means for connection to the removable panel is a rivet.

5. The method of making a ring-shaped finger tab for an easy opening can comprising the steps of:

(1) forming an annular blank including an integral radial strap extending inwardly thereof;

(2) winding said strap around one segment of said annular blank and directing the unwound portion into the interior of said annular blank; and (3) bending the periphery of said blank into a torus with a curvature in continuation of the winding of said strap.

* * * * *